US006319180B1

(12) United States Patent
Kallassy

(10) Patent No.: US 6,319,180 B1
(45) Date of Patent: Nov. 20, 2001

(54) ABDOMINAL EXERCISE DEVICE AND METHOD OF USE

(76) Inventor: Charles Kallassy, 4074 S. Better Dr., Dallas, TX (US) 75229

( * ) Notice: Subject to any disclaimer, the term of this patent is extended or adjusted under 35 U.S.C. 154(b) by 0 days.

(21) Appl. No.: 09/155,135

(22) PCT Filed: Mar. 20, 1997

(86) PCT No.: PCT/US97/06084

§ 371 Date: Dec. 4, 1998

§ 102(e) Date: Dec. 4, 1998

(87) PCT Pub. No.: WO97/34661

PCT Pub. Date: Sep. 25, 1997

Related U.S. Application Data

(60) Provisional application No. 60/013,757, filed on Mar. 20, 1996.

(51) Int. Cl.[7] ..... A63B 23/00

(52) U.S. Cl. ..... 482/140; 482/74; 482/139

(58) Field of Search ..... 128/845; 482/140, 482/74, 139, 10, 148; 602/114, 18; 607/104

(56) References Cited

U.S. PATENT DOCUMENTS

| | | | | |
|---|---|---|---|---|
| 103,026 | * | 5/1870 | Dederick | 128/19 |
| 4,759,543 | * | 7/1988 | Feldman | 297/284 |
| 5,004,228 | * | 4/1991 | Powers | 482/907 |
| 5,122,107 | | 6/1992 | Gardner | 482/140 |
| 5,195,938 | | 3/1993 | Robertson | 482/131 |
| 5,248,287 | | 9/1993 | Nicoletti | 482/106 |
| 5,267,931 | | 12/1993 | Faetini | 482/140 |
| 5,295,949 | | 3/1994 | Hathaway | 482/140 |
| 5,637,067 | * | 6/1997 | Ausmus | 482/140 |

* cited by examiner

*Primary Examiner*—Jerome Donnelly
(74) *Attorney, Agent, or Firm*—Darby & Darby

(57) ABSTRACT

An exercise device for supporting the head, neck, and upper back of a user performing abdominal exercises, the exercise device being provided with a head, neck, and upper back pad (10) having a strap handle assembly (34), and hand loops (78, 81).

12 Claims, 9 Drawing Sheets

ABDOMINAL EXERCISE DEVICE AND METHOD OF USE

This application claims benefit of Provisional Application Ser. No. 60/013,757 filed Mar. 20, 1996.

FIELD OF THE INVENTION

This invention relates generally to exercise devices. More specifically, the present invention relates to an exercise device that provides support to the head, neck and upper back of a user performing abdominal exercises.

BACKGROUND OF THE INVENTION

The abdominal crunch exercise and the many variations thereof, have long been regarded as among the most effective exercises for strengthening and toning the abdominal musculature. However, performing these exercises requires the exerciser to repeatedly contract, stress and strain the flexor muscles of the anterolateral and anterior head and neck, chiefly, the sternocleidomastoid, scaleni, the anterior scaleni, suprahyoids, infrahyoids and, when the aforementioned are in a weakened or exhausted state, the platysma. This stress and strain results in the exerciser not being able to perform enough abdominal crunch-type exercise repetitions to gain the full benefits of such exercise, without discomfort.

There exist devices that have attempted to address the issue of neck strain while performing abdominal crunch exercises. However, the angle and position of the exercises possible on those apparatus not only limit the body's ability to move throughout a full range of motion but force the body into unnatural and limiting positions while performing abdominal exercises. Those apparatus are large, inconvenient, impractical, bulky and expensive, and some, such as that disclosed in U.S. Pat. No. 5,122,107 to Gardner, incorporate very cumbersome and impractical harness devices with a strapping system that requires the exerciser to affix the apparatus to his waist, chest, shoulders and head while the fit of the straps can only be adjusted by cumbersome sliding buckles or other mechanical means.

Other inconvenient, impractical, expensive and bulky devices provide a pad for the head and neck to rest on while the arms and/or hands rest on a frame that rocks through the approximate range of motion of an exerciser performing crunch exercises. This, unfortunately, limits the range of exercise positions and restricts the exercisers movement within the rocking range of the device. The frame does not provide comfortable or proper use by exercisers of certain sizes, shapes and physiques. The pad under the head and neck is of a foam type material that does not provide optimal comfort and positioning to many exercisers because the shape and contour foam does not adjust or allow for the wide variations in anatomical size, shape and contour of the individual exerciser's head and neck area. This pad, even when in its lowest resting position, is often elevated to such a height off the floor as to force the head and neck forward (upward) unnaturally and out of proper biomechanical alignment with the spine, thereby exposing the exerciser to potential harm.

Yet other known devices provide a pad or strap under the neck only, without support to the head, and are attached to a rope or strap which is pulled up by the hands to provide aid to the neck muscles. These devices focus the force of the pulled pad or strap directly on the neck and can force the neck forward with too great a force, and at improper angles, causing undesired stress, strain and potential injury to the neck.

Other devices provide means to apply a pressing force to the abdomen, thus causing the abdominal musculature to contract in opposition to such force. This exercise primarily provides an isometric contraction of the muscles and does not strengthen the musculature throughout its full range of motion, as is desirable in a complete strengthening program.

Although the foregoing exercise devices have been available, whether or not they utilize a pad under the neck or neck and head, they have proven unsuccessful in overcoming the problem of reducing undesired stress and strain of the neck and have often adversely compromised the biomechanics of the individual exerciser. Generally, they do not allow for safe and effective progression to more advanced abdominal crunch type exercises if desired. Additionally, in some cases, these devices impose additional undesired stress and strain to the neck. The aforementioned problems, and resultant exerciser's discomfort and inconvenience, in some cases. results in the exerciser failing to stick to or maintain a regular abdominal exercise program.

It is therefore an object of the invention to allow the exerciser to perform a variety of abdominal crunch-type exercises without requiring any deviation from, or adversely affecting, the optimal biomechanical position of the individual exerciser while performing such exercises.

It is also an object of the invention to provide an abdominal exercise device that incorporates a head, neck and upper back support.

Additionally, it is an object of the invention to provide an abdominal exercise device which has a head, neck and upper back support pad is soft and contoured to assure the comfort of the exerciser.

Yet another object of the invention is to provide an abdominal exercise device that facilitates the progression to more difficult and advanced abdominal crunch type exercises, if and when desired, by the addition of weights.

Another object of the invention is to provide an abdominal exercise device that facilitates the biomechanically correct and comfortable performance of the intermediate to advanced abdominal exercises commonly known as supine lateral bent leg twists and supine lateral straight leg twists.

Yet another object of the invention is to provide an exercise device that facilitates the biomechanicaby correct and comfortable performance of the exercises commonly known as adductor leg lifts and abductor leg lifts.

It is also the object of the invention to provide an abdominal exercise device that is lightweight and small and therefore easy to tote and store, and is easy and cost effective to manufacture, yet reliable and efficient in use.

It is a feature of a preferred embodiment of the invention that a support pad is positioned behind the head, continues downward behind the neck and then to the upper section of the back. Strap handles are attached to the pad and emanate, generally, outward from both lateral sides of the pad. These strap handles are held by the hands and pulled by the arms. This pulling action assists the muscles of the neck while performing abdominal crunch type exercises while at the same time assists in maintaining the correct position of the pad. The arms can be extended at various alignments and angles in relation to the body, or with the elbows resting on the floor at the sides of the exerciser. Used in this manner the invention facilitates the efficient, unencumbered and unrestricted performance of biomechanically correct abdominal crunch type exercises. These straps provide, by means of multiple hand loop holds disposed down their lengths, a quick and unencumbered means of changing the position and angle of the hands and arms, thereby facilitating adjustments for any desired position or variation in the individual exerciser's size, shape or physique while at the same time facilitating numerous abdominal exercise variations. By providing support disposed in such a manner, under the head, neck and upper back, the pulling force used to aid the lift of the head is distributed over the head neck and upper back. With such distribution of the pulling force, there is little risk of stress and strain to the neck while performing abdominal crunch type exercises, providing safe and efficient assistance to the muscles of the neck and therefore facilitating the safe, comfortable and proper execution of numerous abdominal exercise variations.

It is another feature that the support pad is made of a soft and contoured foam-like material or, as in the preferred embodiment, comprised of at least two substantially identical flexible sheets of gas impermeable material being sealed together to form a single or plurality of inflatable chambers. There can be provided at least one outlet means for selectively inflating, deflating and sealing the chamber (s). This selective inflation adjustment allows the exerciser to tailor the pad to their own shape, contour, size and comfort requirements. In an embodiment whereon a plurality of chambers is incorporated a strip that is formed between at least two of the chambers defines a hinge therebetween. The chambers and the hinge conform closely to the contours of the head, neck and upper back area. There can be provided at least one outlet means for selectively inflating, deflating and sealing the chambers provided that such chambers are connected by means of an unsealed section of the strip therebetween or without such unsealed section of the strip, each chamber can be provided with its own outlet means. The pad is therefore more adjustable and form fitting. In any case this inflatable pad provides optimal comfort and positioning of the head and neck without creating additional undesirable strain regardless of variations in anatomical size, shape and contour of the individual exerciser. The pad is of such a thin size and shape so as to safely provide maximum comfort without forcing the head and neck forward (upward) and out of proper alignment with the spine, especially while in the resting position on the floor. The size, shape and contour of the pad, along with the adjustable degree of inflation possible, provides optimal positioning and alignment of the head and neck. These novel features also provide optimal fit and comfort level of the head and neck without imposing restrictions to the movements or positions of the arms, shoulders or upper back.

Another feature of the preferred embodiment of the invention is that an abdominal exercise device provides handles, generally disposed to the rear of and securely attached to the head, neck and upper back support pad. When abdominal crunch-type exercises are performed such exercises can be made increasingly more difficult by extending the hands and arms over or behind the head. The further above or behind the head the hands and arms are placed, the more difficult the exercise. Provided, therefore, are one or more rearwardly disposed handles, which can be held by the user while performing abdominal crunch-type exercises. This not only allows the exerciser to maintain the correct position of the head, neck and upper back pad while maintaining proper exercise form, but provides for progression to more difficult and advanced abdominal crunch-type exercises thereby facilitated, if and when desired.

It in another feature of the invention that additional weights can be added in the form of conventional wrist weights worn about the wrists, or held by the hands, with the hands and arms positioned on, or at an angle and aligned in relationship to, the body so as to create the desired additional load. Conventional ankle weights, worn about the ankles, create additional load when performing abdominal crunch-type exercises that involve the lifting of the knees or legs, as is the case when the exercises commonly known as a 'combination crunch' and a 'reverse crunch' are performed. Another way to add weight is by placing ankle weights, wrist weights or conventional weight plates on the chest or by holding them in the hands, to create any such additional load desired by the exerciser while performing abdominal crunch-type exercises.

It is another feature of the invention that supine lateral leg twists are readily performed. The body lies on its side with head and neck resting comfortably on the pad, the bands are placed into hand hold loops at the terminal ends of the respective sides of the strap handles. The arms are then extended straight out to the sides of the body the legs are then lifted and the exercises are performed. The arms exert force on the straps in such a way as to create a mechanical action so as to assist the body in maintaining the balance and position necessary for proper performance of these exercises.

It is another feature of the invention that adductor and abductor leg lifts are readily performed. The body lies on its side with head and neck resting comfortably on the pad, the hands hold onto the strap handles in such a way as to assist the body in maintaining the balance and position necessary to perform these exercises properly.

BRIEF DESCRIPTION OF THE DRAWING

The above and further objects, features and advantages of the present invention will become apparent upon consideration of the following detailed description of presently preferred embodiments thereof, especially when considered in conjunction with the accompanying drawings wherein like reference numerals in the various figures are utilized to designate like components, and wherein.

DETAILED DESCRIPTION OF THE PREFERRED EMBODIMENTS

While the invention will be described in connection with a number of preferred embodiments, it should be understood that this description is not intended to limit the invention to these embodiments. On the contrary, it is intended to cover all alternatives, modifications and equivalents as may be within the spirit and scope of the invention.

Figure 1:
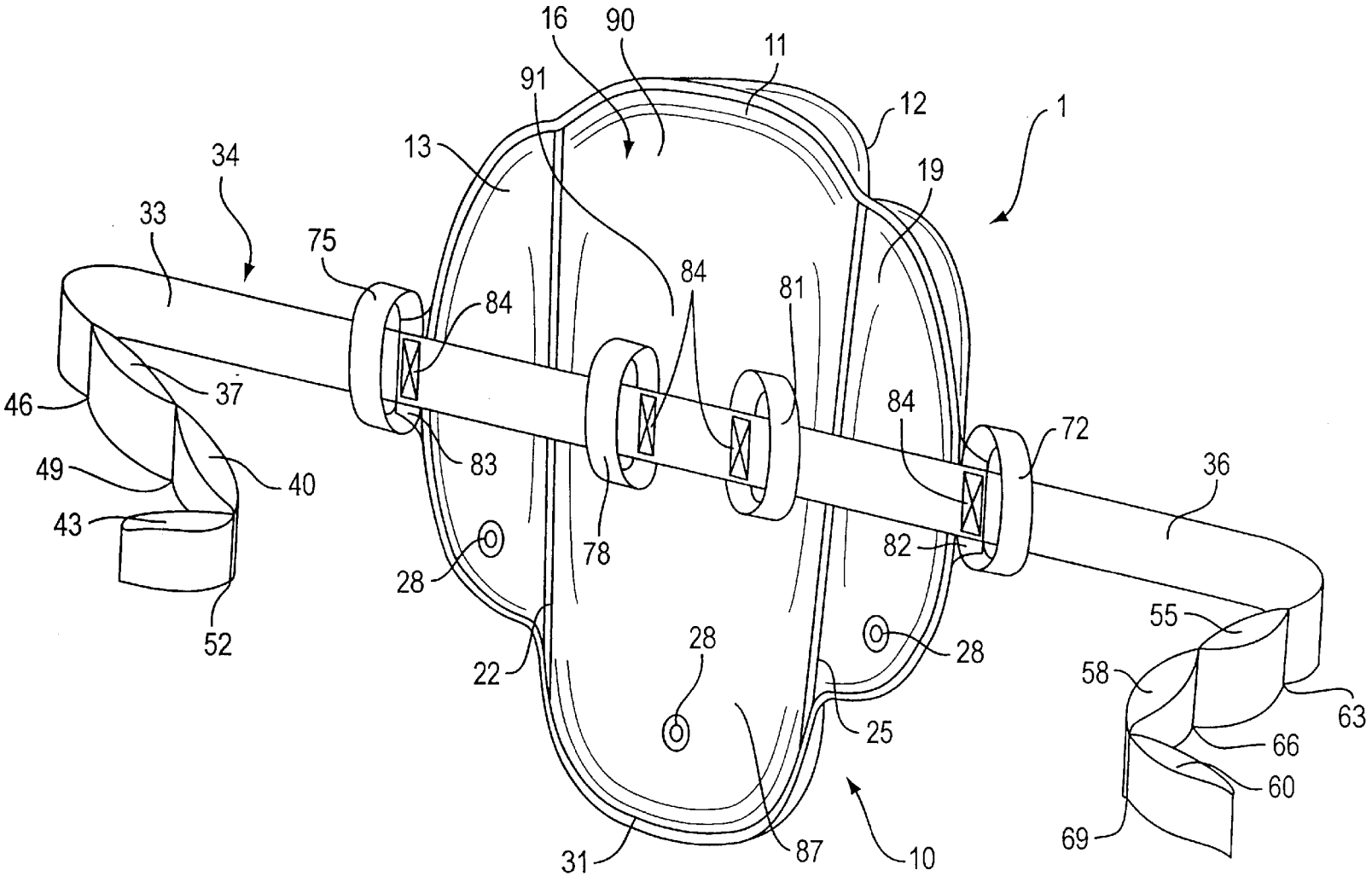
FIG. 1 is a perspective view of the preferred embodiment of the present invention with a head, neck and upper back pad consisting of a plurality of separately inflatable chambers.

Shown in FIG. 1 is a first embodiment of the exercise device 1. Although the head, neck and upper back pad 10 of the device can be formed of any suitable foam-like material this, the preferred embodiment, incorporates an inflatable version of pad assembly 10. Pad assembly 10 is formed by two substantially identical flexible sheets of gas impermeable material, such as supported or unsupported PVC, 11 and 12. These sheets are sealed to each other along their outer edges by outlining chamber seal 31. This seal 31 is made by a process such as Radio Frequency (RF) Heat Sealing or any other as would be commonly utilized by those skilled in the art. Two generally vertical hinge seams 22, 25 divide the pad assembly 10 into three chambers 13, 16, 19. These chambers can be provided with individual conventional outlet valves 28 permitting access to the respective chamber to inflate, deflate and seal the respective chambers. The hinge seams 22 and 25, along with the adjustable degree of inflation of the chambers, allow the pad assembly 10 to conform to the shape and contour of the individual exerciser's head, neck and upper back area for a properly alignment and comfortable fit.

In accordance with yet another aspect of the invention, the strap handle assembly 34, preferably including a web strap, is attached to Pad assembly 10 by any means common in the art. For example, there can be, at the lateral edges of chambers 13 and 19 (disposed outside of the outlining chamber seal 31) two sew mount tabs 82 and 83. These tabs 82 and 83 may be integral with the supported PVC sheets 11 and 12 that form the body of Pad assembly 10. Strap handle assembly 34 can be securely attached to tabs 82 and 83 by means of a sewmount arrangement 84, or other such means known to those skilled in the art. Also attached to tabs 82 and 83 by like means are hand loops 72 and 75. Attached to the center rear area of strap handle assembly 34 are hand loops 78 and 81. These loops are attached directly to the strap assembly by means of a sewmount arrangement or other such means, as would be known to those skilled in the art. Strap handle lengths 33 and 36 mirror each other and emanate laterally from their respective sides of pad assembly 10. Disposed down and along their lengths are a plurality of hand holds in the form of hand loops, in this case three on each side 37, 40, 43 and 55, 58, 60 respectively. These loops are achieved, in this case, by the terminal ends of length lengths 33, 36 being folded back and therefore creating a double layer of strap on each side. Sewn stitches, 46, 49, 52 and 63, 66, 69 respectively, are applied, thereby creating each of the individual loop holds 37, 40, 43 and 55, 58, 60.

Figure 1A:
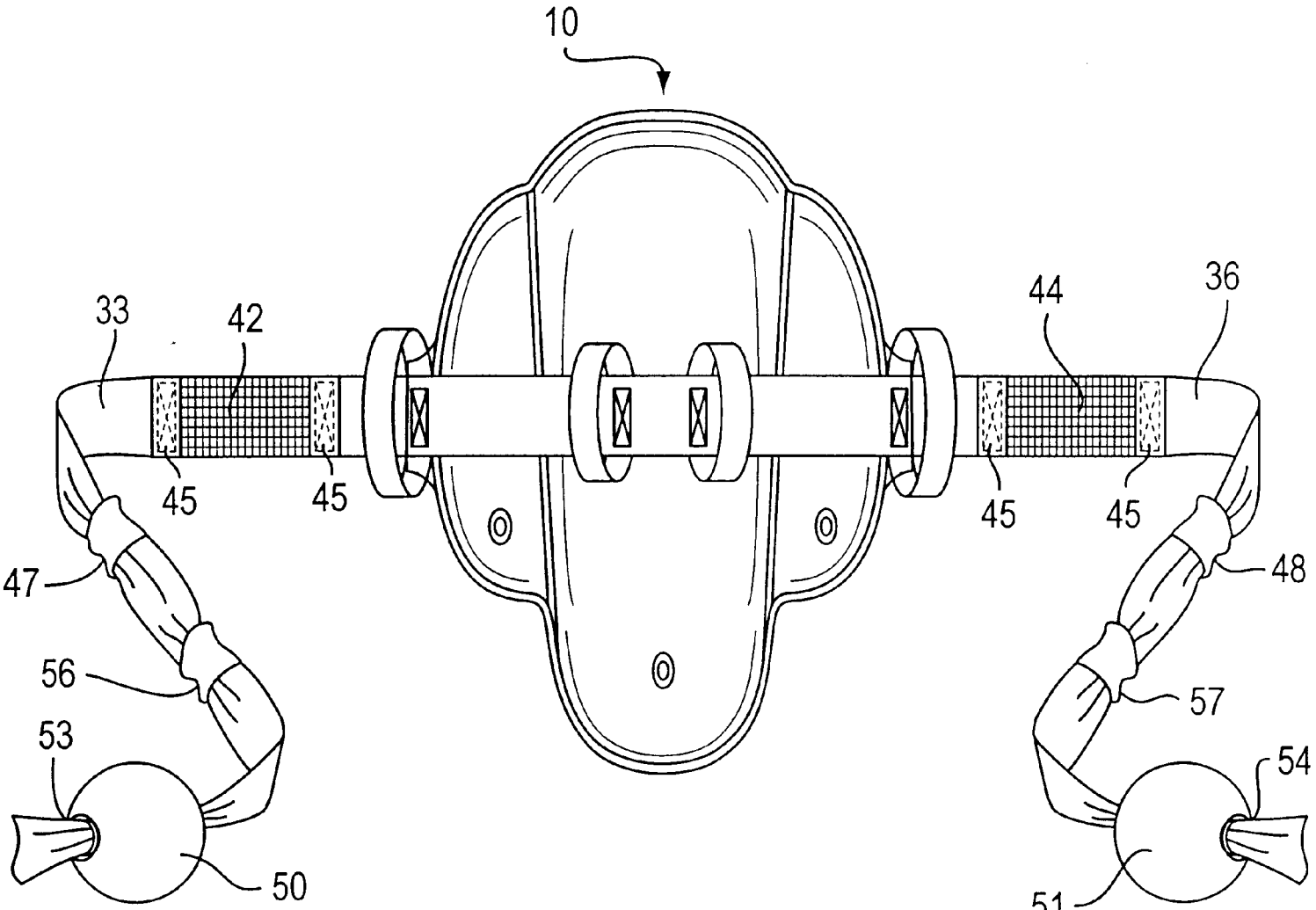
FIG. 1A is a perspective view of an additional embodiment of the present invention with an elastic component incorporated on the strap assembly, two knots performing as hand positioning holds and two hand hold balls.

FIG. 1A shows modifications to the apparatus of FIG. 1. Elastic material lengths 42 and 44 are attached to a split in strap handle lengths 33 and 36, respectfully, by any such means common to those skilled in the art, in this case, by means of a sewmount arrangement 45. These elastic straps help to modulate the amount of force that is used to lift the head, neck and upper back while utilizing the invention.

Knots 47, 56 and 48, 57 are disposed down and along the lengths of straps 33 and 36 and perform as hand positioning holds.

Hand hold end stop balls 50 and 51 are formed of a hard rubber material or any other suitable substance. Bored through their diameters are holes 53 and 54. These holes are of such a size that the terminal ends of straps 33 and 36 can be forced through them and positioned during assembly, yet small enough that they do not easily slide out of such position. Balls 50 and 51 perform as hand positioning holds.

Figure 2:
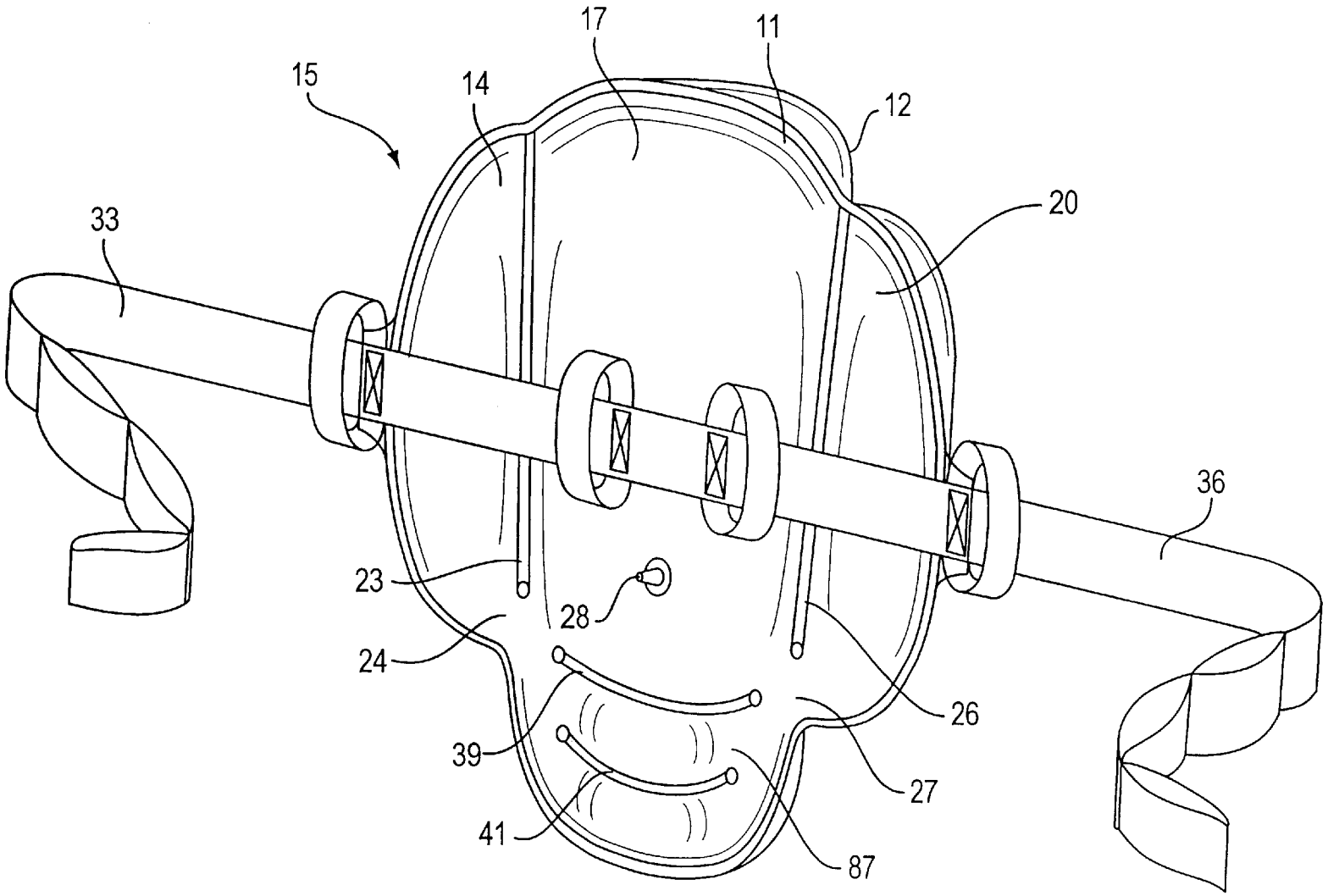
FIG. 2 is a perspective view of an additional embodiment of the present invention with a head, neck and upper back pad consisting of a plurality of chambers in communication with each other and inflated by a single valve.

Turning now to FIG. 2, there will now be described a modification of the apparatus: On head, neck and upper back pad 15, there are a plurality of chambers, in this case three 14, 17, 20 . Chambers 14, 17, 20 can be in communication with each other since the seams 23, 26 at locations 24, 27 are short, of the full length of the chamber and thereby create a common air manifold that can be inflated, deflated or sealed by a single outlet valve 28. There are also provided two generally horizontal RF heat seal seams 39, 41 disposed in the upper back area 87 of pad 15. These seams 39, 40 restrict the amount of inflation possible to this area, thereby creating a thinner area of the pad 15 at its upper back area 87. This thinner area may be desirable for some exercisers to allow for a full range of motion while performing abdominal crunch type exercises.

Figure 3:
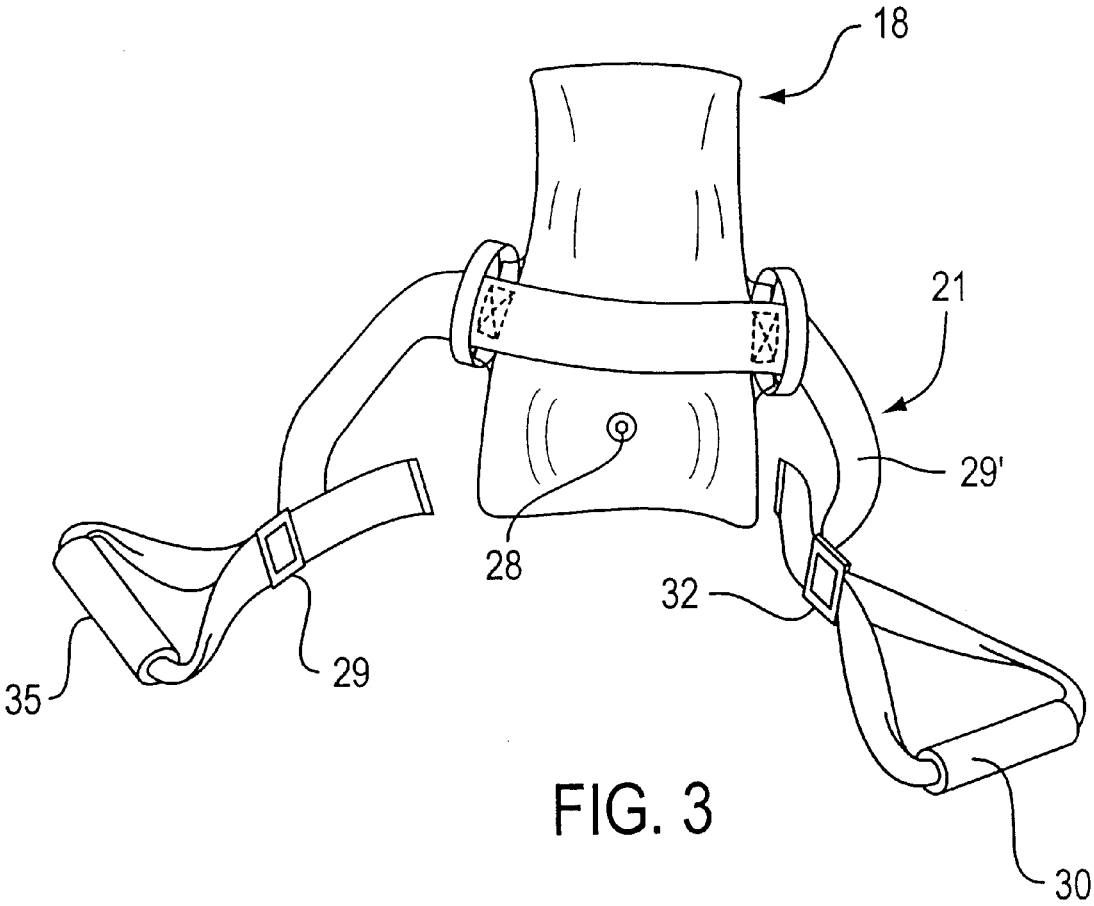
FIG. 3 is a perspective view of an additional embodiment of the present invention with a head, neck and upper back pad consisting of a single chambers and a slide buckle means of strap length adjustment.

Turning now to FIG. 3, there is shown an additional embodiment that incorporates a single chambered head neck and upper back pad 18 that can be inflated, deflated or sealed by a single outlet valve 28. Another modification to the device shown here is an adjustable length handle assembly 21, that utilizes a pair of common slide buckle adjusting assemblies 29, 32, applied to the respective sides of strap 29'. Slide buckle adjusting assemblies 29, 32 allow the exerciser to adjust the length of the respective strap ends to the appropriate lengths required for performing a given exercise. Tubular foam covered handles 30, 35 can be applied to the straps thus providing a comfortable means by which to hold the straps during use.

Method of Use

Figure 4:
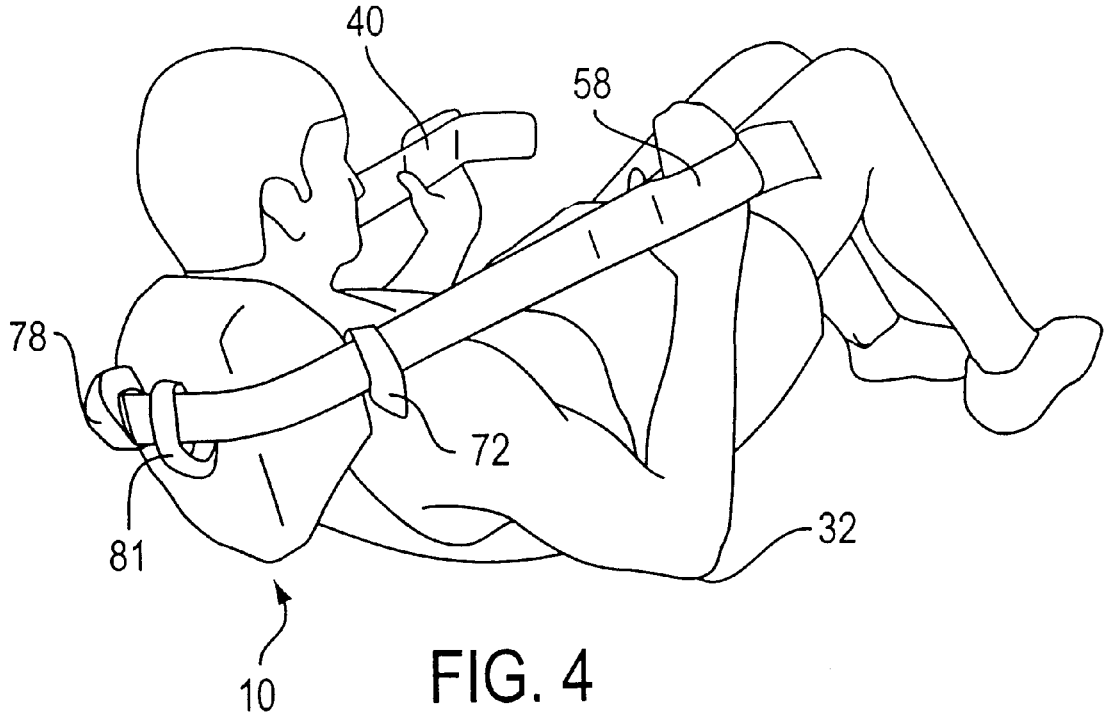
FIG. 4 is a perspective view of an exerciser using the present invention and positioned to perform an abdominal crunch exercise.

The following are descriptions of some of the variety of unique exercises that are facilitated and or more efficiently and effectively performed by utilizing the novel apparatus as taught herein. These exercises and exercise variations along with the muscles and or muscle groups therefore exercised include:

FIG. 4, shows an exerciser performing an abdominal crunch exercise utilizing the inventive device as described herein. With the body in a supine position on the floor, head, neck and upper back pad 10 is positioned with area 90 positioned at the back of the head, area 91 at the back of the neck and area 87 at the upper middle area of the back. The hands are placed in the desired hand loops, in this case 58 and 40, and a gentle pull or pressing force is exerted by the arms to direct the pad upward and slightly forward so as to thereby lift the head, neck and shoulders. Such placement and action of the pad 10 thereby disperses the force over to the back of the head, neck and upper back area to safely assist the muscles of the anterolateral and anterior head and neck while performing such abdominal crunch exercises. The elbows are positioned at 32 on the floor, serving as a pivot to further aid in the proper performance of the exercise while maintaining the arms and hands in a lower position, as is desirable for beginning or intermediate level exercisers.

The exercise is performed by contracting the abdominal muscles thereby lifting the shoulders off of the floor to the position as shown. The shoulders are then lowered and the body returns to the starting position. Without releasing the abdominal contraction, the exercise is then repeated for the desired number of repetitions.

It should be understood that, in general, the exercise can be made to address different muscles and can be made increasingly more difficult by changing the position and orientation of the body, by extending the hands and arms upward, away from, over, or behind the head (the further above or behind the head the hands and arms are placed, the more difficult the exercise will be), and by changing the position and action of the legs and feet and by adding weight to certain areas of the body, as will all be further explained below.

The major muscles that are involved in the abdominal crunch exercise are the upper rectus abdominous and the internal and external obliques.

Figure 5:
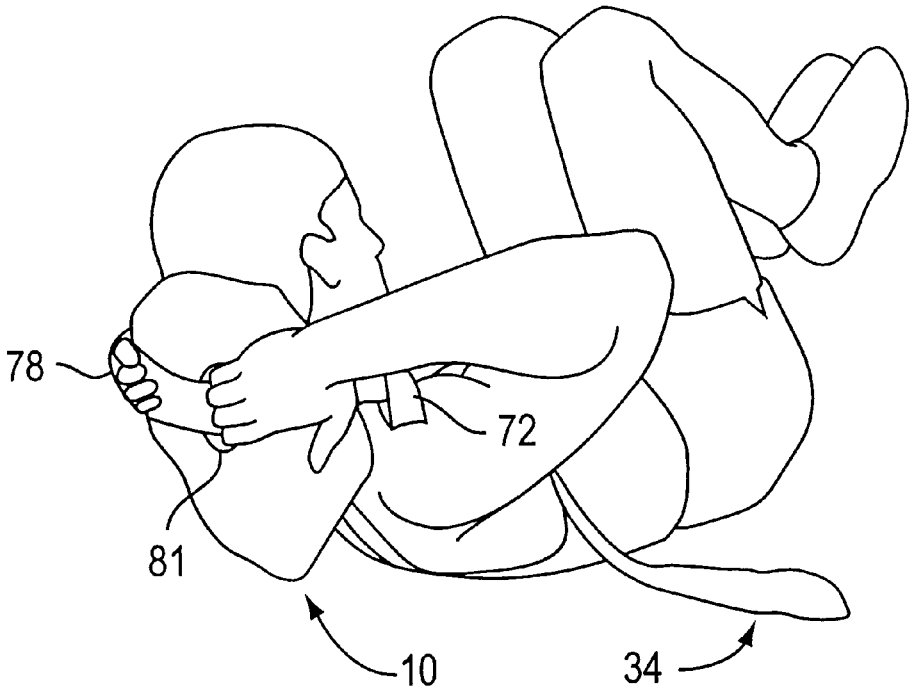
FIG. 5 is a perspective view of an exerciser using the present invention and positioned to perform a combination crunch abdominal exercise with the hands behind the neck.

FIG. 5, shows an exerciser performing an intermediate level combination crunch abdominal exercise with the hands behind the neck, utilizing the inventive device as described herein. The hands are disposed behind the head, neck and upper back pad 10 and are holding hand loops 78 and 81.

Figure 9:
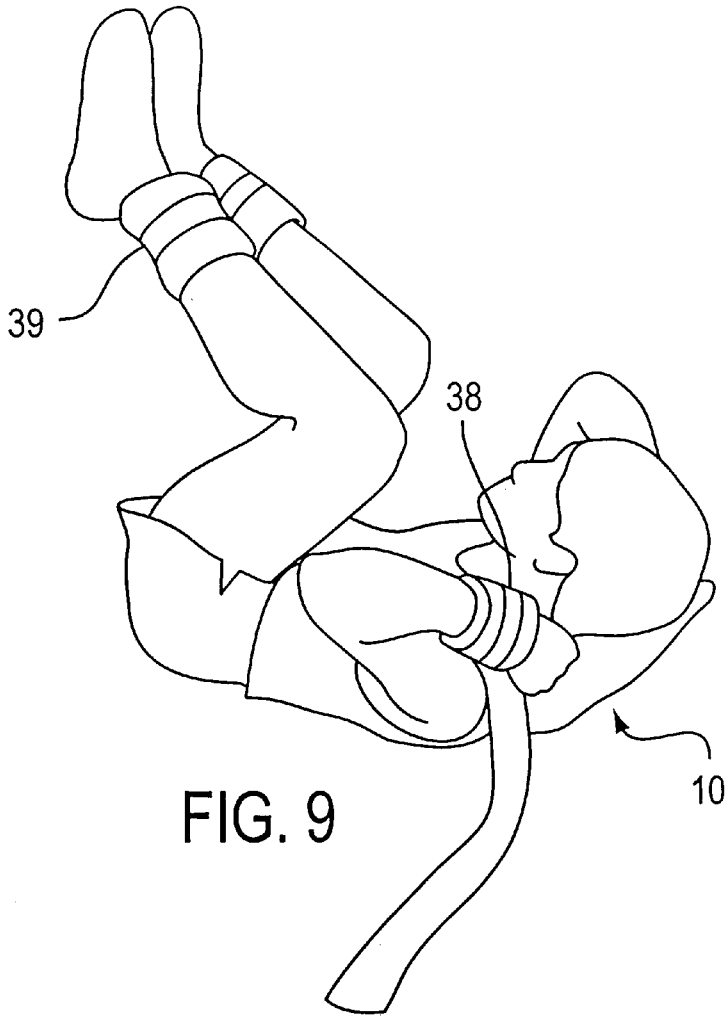
FIG. 9, is a perspective view of an exerciser using the present invention and positioned to perform a combination crunch abdominal exercise with ankle and wrist weights attached to the exerciser's ankles and wrists.

Starting in a supine position the feet are off of the floor and the knees are bent and aiming upward. The exercise is performed by contracting the abdominal muscles thereby lifting the shoulders off of the floor, simultaneously, the knees are lifted upward, thereby raising the pelvis off of the floor to the position as shown. The shoulders and knees are then lowered and the body returns to the starting position. Without releasing the abdominal contraction, the exercise is then repeated for the desired number of repetitions. A more advanced version of this combination crunch abdominal exercise is shown in FIG. 9. Here, a pair of ankle weights 39 and a pair of wrist weights 38 are utilized to create additional load and, therefore, difficulty.

The major muscles that are involved in the combination crunch abdominal exercise are the upper and lower rectus abdominous and the internal and external obliques.

Figure 6:
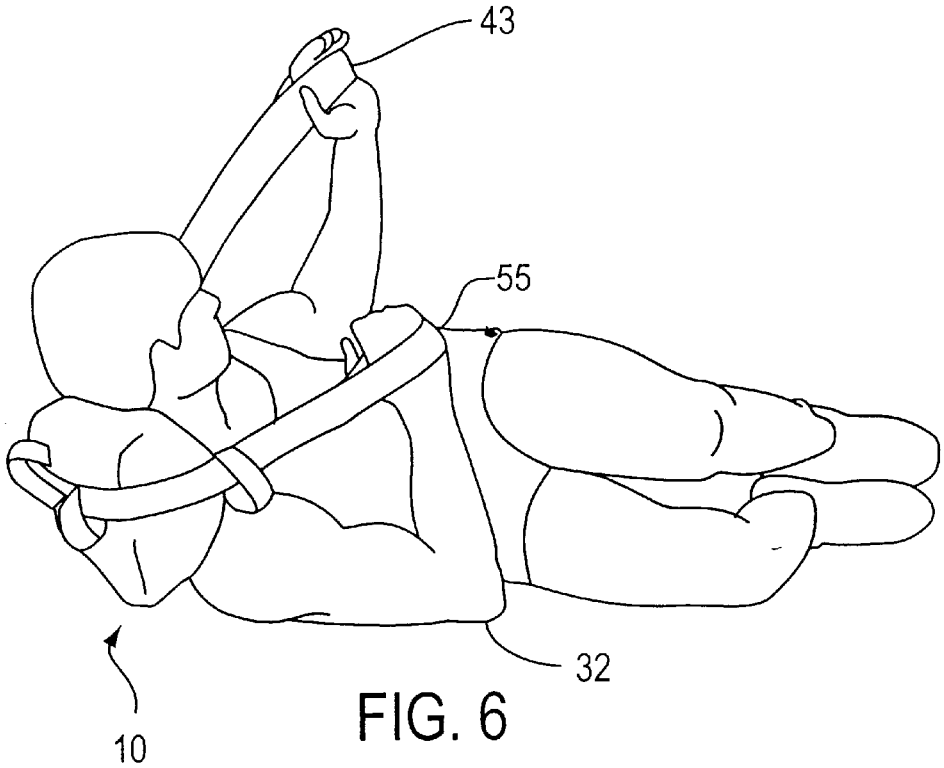
FIG. 6 is a perspective view of an exerciser using the present invention and positioned to perform an oblique crunch abdominal exercise.

Shown in FIG. 6, is an exerciser performing an oblique crunch abdominal exercise with the body lying on the right side, head, neck and upper back pad 10 is positioned with area 90 positioned at the back right side of the head, area 91 at the back right side of the neck and area 87 slightly to the right of the upper middle area of the back. The right hand is placed into proximal hand loop 55 and the left hand into distal hand loop 43, thus creating an offset relationship of the hands and arms. The left elbow is placed at or above the left side of the body and the left hand is aimed, generally, upward and forward. The right elbow rests on the floor. functioning as a pivot and the right hand is aimed, generally, upward.

The exercise is performed by contracting the lateral abdominal muscles thereby lifting the shoulders upward and off of the floor with the gentle pressing force exerted, and the offset relationship of, the hands and arms. This provides assistance to the muscles of the anterior and anterolateral head and neck. The pivot of the right elbow, provides the balance required for the comfortable and biomechanically correct performance of the exercise. The shoulders are then lowered and the body returns to the starting position. Without releasing the abdominal contraction, the exercise is then repeated for the desired number of repetitions. The positions are then reversed to the other side and the exercise is repeated.

The major muscles that are involved in the oblique crunch abdominal exercise are the quadratus lumborum, the internal and external obliques, the upper and lower rectus abdominous and the erector spine.

Figure 7:
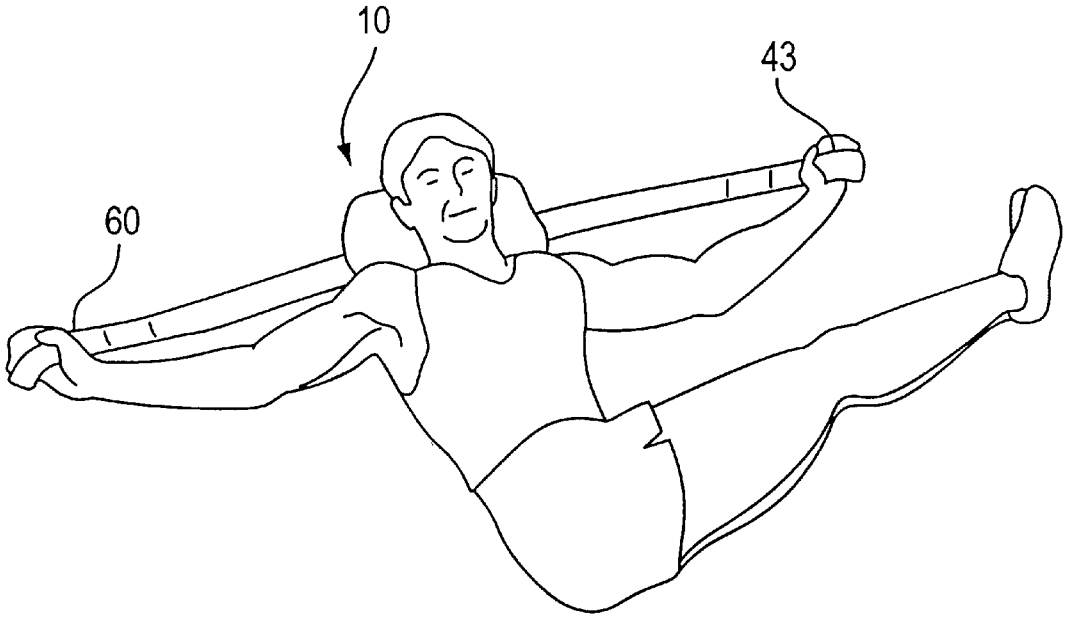
FIG. 7, is a perspective view of an exerciser using the present invention and positioned to perform a straight leg reverse trunk twist abdominal exercise.

FIG. 7, shows an exerciscr performing a straight leg, reverse trunk twist abdominal exercise, utilizing the inventive device as described herein. The head, neck and upper back rest on pad 10 and the arms are extended with the hands inserted into hand loops 60 and 43, respectively.

Starting in a supine position the feet and legs are aimed upward. The exercised is performed by slowly lowering the legs to one side of the body, as shown, then lifting back through the starting position, lowering to the other side and raising back through the starting position thus completing one repetition of the exercise. The exercise is then repeated for the desired number of repetitions.

While performing the exercise the hands press outward on the loop holds 60 and 43 providing an oppositional resistance force to counterbalance the action of the legs thereby facilitating the safe and biomechanically correct execution of the exercise.

A slightly less advanced version of this exercise could be performed in the same manner as described but with the legs bent at the knees throughout the exercise.

The major muscles that are involved in the reverse trunk twist exercise are the quadratus lumborum, the internal and external obliques, the upper and lower rectus abdominous and the erector spine.

Figure 8:
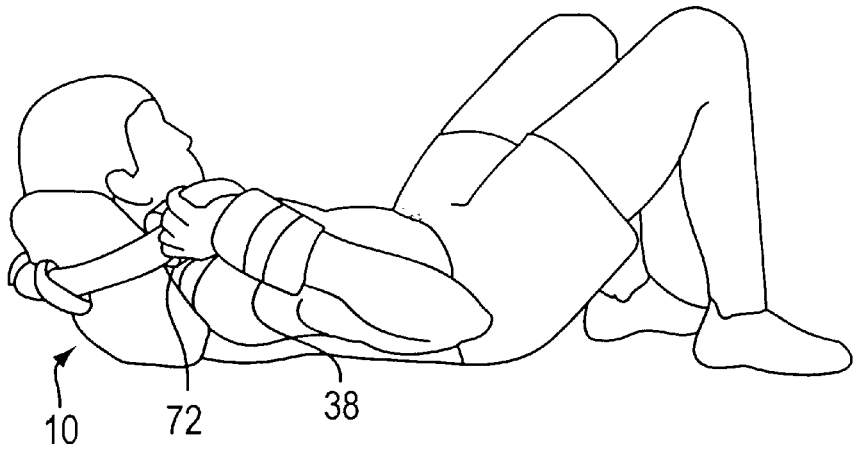
FIG. 8, is a perspective view of an exerciser using the present invention and positioned to perform an abdominal crunch and pelvic tilt exercise with wrist weights attached to the exerciser's wrists.

FIG. 8 shows an exerciser performing an abdominal crunch with pelvic tilt exercise with a pair of wrist weights 38 attached to the exerciser's wrists, utilizing the inventive device as described herein. The hands are disposed behind the head, neck and upper back pad 10 and hold hand loops 72 and 75.

Starting in a supine position the feet are placed on the floor and the knees are bent, aiming upward. The exercise is performed by contracting the abdominal muscles, thereby lifting the shoulders off of the floor. Simultaneously, the lower abdominal muscles are contracted, resulting in the pelvis tilting posteriorly, the lower pelvis is thus lifted off of the floor to the position as shown. The shoulders and pelvis are then lowered and the body returns to the starting position. Without releasing the abdominal contraction, the exercise is then repeated for the desired number of repetitions.

A slightly less advanced version of this exercise could be performed in the same manner as described but without the use of the wrist weights and or by the hands positioned into, for example, hand loops 43 and 60 and the hands and arms aiming upward.

The major muscles that are involved in the abdominal crunch with pelvic tilt exercise are the upper and lower rectus abdominous, internal and external obliques, psoas, iliacus, gluteus medius and minimus.

Figure 10:
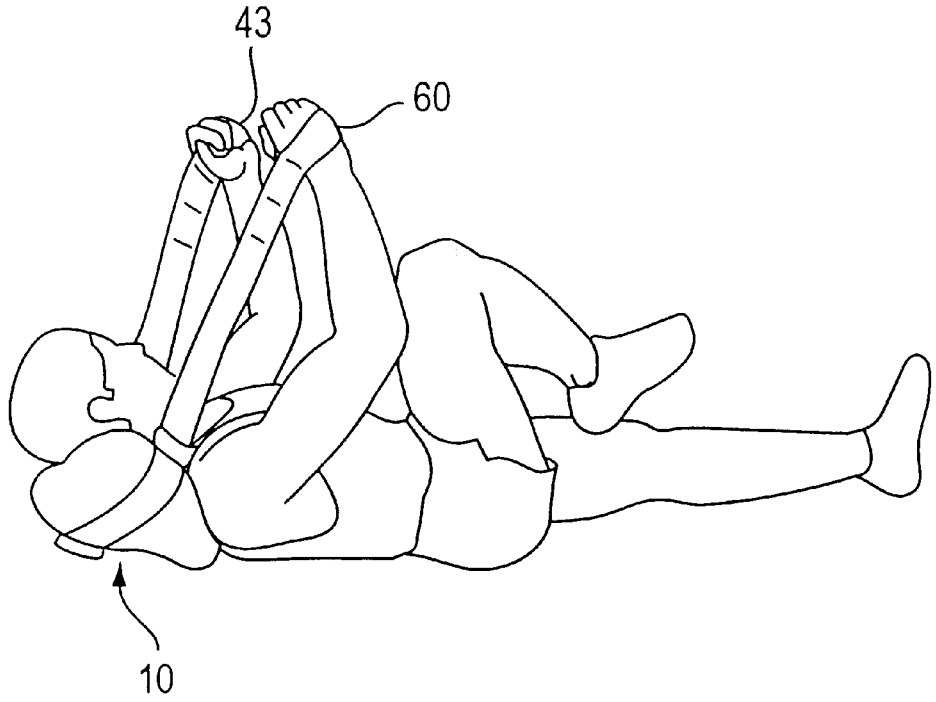
FIG. 10, is a perspective view of an exerciser using the present invention and positioned to perform an alternating knee lift abdominal crunch exercise.

Shown in FIG. 10, is an exerciser performing an alternating knee lift abdominal crunch exercise utilizing the invention as described herein. With the body in a supine position on the floor, the head, neck and upper back positioned on pad 10. The hands are placed in the desired hand loops, in this case 43 and 60

The exercise is performed by contracting the abdominal muscles, and a gentle upward and slightly forward pressing force exerted by the arms. This results in the head, neck and shoulders being lifted upward, and slightly forward, off of the floor. Simultaneously, the right knee is lifted toward the chest and the left leg is lifted slightly off of the floor as shown. The shoulders are then lowered, the leg action alternates, and the body returns to the starting position. Without releasing the abdominal contraction, the exercise is then repeated for the desired number of repetitions. The exercise can then be performed with the left knee lifting as the shoulders lift. A more advanced version of this exercise could be achieved by adding weights to the ankles and/or wrists.

In addition, this exercise can also be performed with a twisting action of the torso. As the exercise is performed, the right hand or elbow crosses over the body as does the left knee, and they touch. This is then alternately repeated with the left hand or elbow and right knee.

The major muscles that are involved in the alternating knee lift abdominal crunch exercise are the upper and lower rectus abdominous, the internal and external obliques, iliopsoas, rectus femoris and pectineus.

Figure 11:
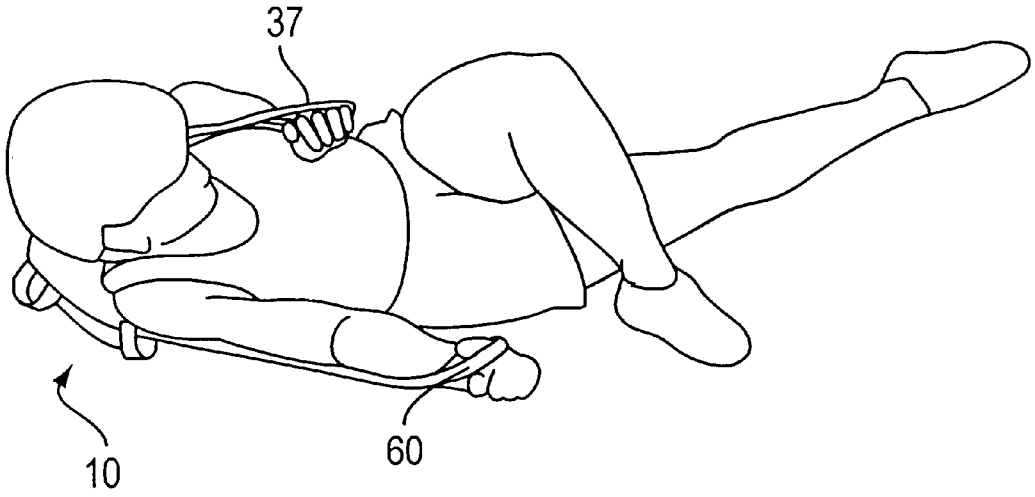
FIG. 11, is a perspective view of an exerciser using the present invention and positioned to perform an adductor leg lift exercise.

Turning now to FIG. 11, shown here is an exerciser performing an adductor leg lift exercise. With the body lying on the right side, The head, neck and upper back are resting on pad 10. Pad 10 is positioned with area 90 positioned at the back right side of the head, area 91 at the back right side of the neck and area 87 slightly to the right of the upper middle area of the back. The right hand is placed into distal hand loop 60 and the left hand into proximal hand loop 37, thus creating an offset relationship of the hands and arms. The left arm and hand are placed at the left side of the body. The right arm rests on the floor. The right leg extends straight down and the right leg is bent at the knee with the foot placed on the floor close to and in front of the left knee.

The exercise is performed by lifting the straight left leg up from the floor with the foot aimed generally forward, as shown, and then lowering the leg back to the starting position. The pressing action of the hands on hand loops 60 and 37, and the offset relationship of the hands and arms, provides assistance in stabilizing the body thus insuring the comfortable and biomechanically correct performance of the exercise. The exercise is then repeated for the desired number of repetitions. The positions are then reversed to the other side and the exercise is repeated.

A more advanced version of this exercise could be achieved by adding weights to the ankles.

The major muscles that are involved in the adductor leg lift exercise are the adductor longus, brevis and magnus and the gracilis.

Figure 12:
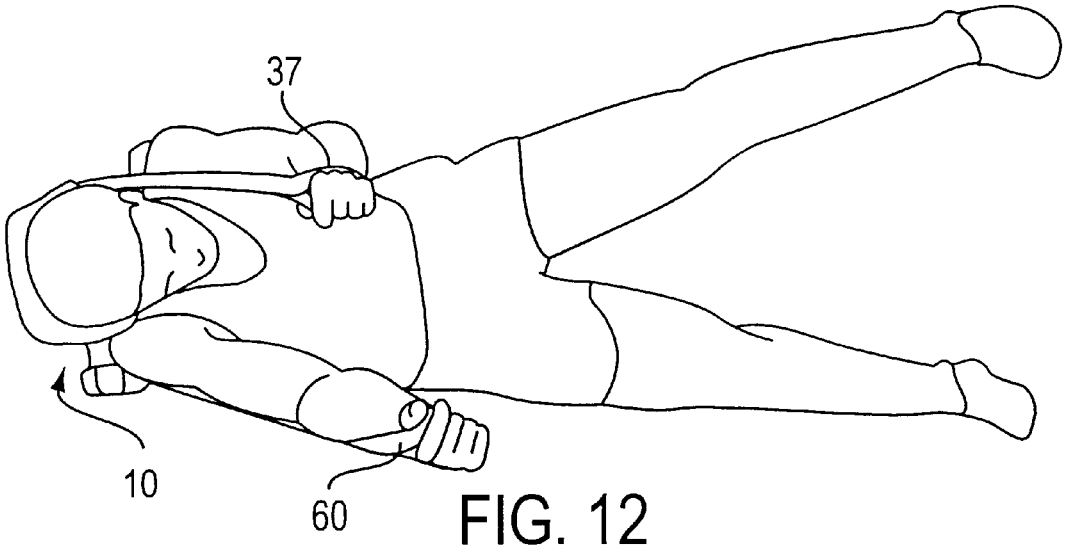
FIG. 12, is a perspective view of an exerciser using the present invention and positioned to perform an abductor leg lift exercise.

FIG. 12, shows an exerciser performing an abductor leg lift exercise. With the body lying on the right side, The head, neck and upper back are resting on pad 10. Pad 10 is positioned with area 90 positioned at the back right side of the head, area 91 at the back right side of the neck and area 87 slightly to the right of the upper middle area of the back. The right hand is placed into distal hand loop 60 and the left hand into proximal hand loop 37, thus creating an offset relationship of the hands and arms. The left arm and hand are placed at the left side of the body . The right arm is resting on the floor. The legs are extending straight down.

The exercise is performed by lifting the left leg straight up with the foot aimed generally forward, as shown, and then lowering the leg back to the starting position. The pressing action of the hands on hand loops 60 and 37, and the offset relationship of the hands and arms, provides assistance in stabilizing the body thus insuring the comfortable and biomechanically correct performance of the exercise. The exercise is then repeated for the desired number of repetitions. The positions are then reversed and the exercise is repeated on the other side.

A more advanced version of this exercise could be achieved by adding weights to the ankles.

The major muscles that are involved in the abductor leg lift exercise are the gluteus medius and gluteus minimus.

As the invention has now been clearly described here, it should be clearer now that many additions, modifications and substitutions other than those described, are within the ability of those skilled in the art and within the scope of the invention.

What is claimed is:

1. An abdominal exercise device comprising:

a first and second fluid impermeable, opposed sheets sealed along an outline seal to define an inflatable chamber therebetween;

means for selectively inflating, deflating and sealing said chamber;

a first strap connected to one of said first sheet and said second sheet and emanating outwardly from said chamber to a distal end of said first strap, a plurality of hand holds formed along said first strap at predetermined varying distances from said chamber; and a second strap connected to one of said first and second sheets and emanating outwardly from said chamber to a distal end of said second strap, a plurality of hand holds formed along said first strap at predetermined varying distances from said chamber.

2. The abdominal exercise device according to claim 1, wherein said plurality of hand holds formed along said first and second straps are disposed closer to said respective distal end than said chamber.

3. The abdominal exercise device according to claim 2, wherein said second strap is connected to one of said first sheet and said second sheet at a predetermined location that is essentially opposite to a predetermined connection location of said first strap to one of said first sheet and said second sheet.

4. The abdominal exercise device according to claim 1, wherein said second strap is connected to one of said first sheet and said second sheet at a predetermined location that is essentially opposite to a predetermined connection location of said first strap to one of said first sheet and said second sheet.

5. The abdominal exercise device according to claim 1, wherein said plurality of hand holds are loops formed in the respective strap.

6. The abdominal exercise device according to claim 1, wherein said plurality of hand holds are at least one of knots formed in the respective strap and a ball attached to the respective strap.

7. The abdominal exercise device according to claim 1, wherein said chamber is dimensioned and shaped to simultaneously contact the rear of the head, neck and upper back of a user when placed in supporting position behind a user's head.

8. The abdominal exercise device according to claim 1, further comprising a handle disposed at said respective distal end of said first and second straps.

9. The abdominal exercise device according to claim 1, wherein said chamber is comprised of a plurality of separate variable inflatable chambers, each of said chambers having means for selectively inflating, deflating and sealing said respective chamber.

10. The abdominal exercise device according to claim 9, wherein an uninflatable strip is formed between at least two of said chambers to define a hinge therebetween.

11. The abdominal exercise device according to claim 1, wherein said first strap and said second strap are a one piece unitary member.

12. The abdominal exercise device according to claim 11, further comprising at least one hand hold formed along said first and second straps proximate to said chamber.

* * * * *